United States Patent [19]

Newell et al.

[11] 4,174,944

[45] Nov. 20, 1979

[54] SINGLE LEAD ELECTRICALLY-ACTIVATED FLASHLAMP

[75] Inventors: P. Bruce Newell, Carlisle; James C. Morris, Wakefield; John F. Waymouth, Marblehead, all of Mass.

[73] Assignee: GTE Sylvania Incorporated, Stamford, Conn.

[21] Appl. No.: 873,250

[22] Filed: Jan. 30, 1978

[51] Int. Cl.[2] ..... F21K 5/02

[52] U.S. Cl. ..... 431/359; 431/362; 431/360

[58] Field of Search ..... 431/360, 362, 365, 357, 431/358, 359; 313/201, 234

[56] References Cited

U.S. PATENT DOCUMENTS

| | | | |
|---|---|---|---|
| 1,904,057 | 4/1933 | Kobayashi | 431/365 |
| 2,146,579 | 2/1939 | Inman | 313/201 |
| 2,768,517 | 10/1956 | Atkinson et al. | 431/362 |
| 2,775,718 | 12/1956 | Dubilier | 313/201 |
| 2,787,559 | 4/1957 | Coney et al. | 431/360 |
| 2,811,846 | 11/1957 | Rively | 431/362 |
| 2,858,686 | 11/1958 | Roth | 431/360 |
| 2,947,913 | 8/1960 | Trostler | 313/201 |
| 3,167,015 | 1/1965 | Smith et al. | 431/360 |
| 3,562,508 | 2/1971 | Hoffacker | 431/359 |
| 3,649,864 | 3/1972 | Willemsen | 313/201 |
| 3,873,261 | 3/1975 | Cote | 431/362 |
| 3,897,196 | 7/1975 | Saunders et al. | 431/362 |
| 3,941,555 | 3/1976 | Anderson et al. | 431/358 |
| 3,951,582 | 4/1976 | Holub et al. | 431/359 |
| 3,959,860 | 6/1976 | Schindler | 29/25.16 |
| 4,040,777 | 8/1977 | Collins et al. | 431/359 |
| 4,045,712 | 8/1977 | DeTommasi | 431/359 |

FOREIGN PATENT DOCUMENTS

| | | | |
|---|---|---|---|
| 697284 | 9/1940 | Fed. Rep. of Germany | 431/358 |

*Primary Examiner*—Carroll B. Dority, Jr.
*Assistant Examiner*—William R. Henderson
*Attorney, Agent, or Firm*—Lawrence R. Fraley

[57] ABSTRACT

An electrically fired flash lamp which utilizes a single conductive lead member. The lead protrudes within the lamp's envelope and is covered by a quantity of primer material. A conductive coating (e.g. tin oxide) covers a major portion of the external surface of the envelope and is capacitively coupled through the envelope's wall to the combustible filamentary material (e.g. shredded zirconium) therein. In another embodiment, a second conductive coating is located on the internal surface of the envelope opposite the outer coating and in electrical contact with the filamentary material. Accordingly, both coatings are capacitively coupled when the lamp is electrically fired. A sequentially-activated array of the above lamps is also disclosed.

18 Claims, 4 Drawing Figures

SINGLE LEAD ELECTRICALLY-ACTIVATED FLASHLAMP

CROSS REFERENCE TO COPENDING APPLICATIONS

An application listed under Ser. No. 873,258, and entitled "Leadless Electrical Flash Lamp" (Inventor: T. Fohl) is filed concurrently herewith. Ser. No. 873,258, is assigned to the same assignee as the instant application and defines a leadless, electrically-activated flash lamp which relies on capacitive coupling through the envelope to achieve flashing when suitable electrical current is supplied to a pair of spaced conductive films on the external surface of the envelope.

Another application under Ser. No. 873,378, now U.S. Pat. No. 4,135,227, "Leadless Electric Flash Lamp Assembly" (Inventor: T. Fohl), is also filed concurrently herewith and is assigned to the assignee of this invention. The assembly defined U.S. Pat. No. 4,195,227, is particularly suited for utilizing the leadless lamps of Ser. No. 873,258.

Still another application is filed concurrently herewith and listed under Ser. No. 873,376. Ser. No. 873,376, "Improved Means For Electrically Contacting Flash Lamp Having External Conductive Coating" (Inventors: P. B. Neqwell et al), defines several means for electrically contacting the conductive coatings located on the flash lamps described in this application and in the above application Ser. No. 873,258.

BACKGROUND OF THE INVENTION

The invention relates to photoflash lamps and particularly to photoflash lamps which are electrically activated. Even more particularly, the invention relates to flash lamps of the above variety wherein a single lead is utilized.

Most prior art flash lamps which are electrically-activated require at least two conductive leads which extend within the lamp's glass envelope. Examples are illustrated in U.S. Pat. Nos. 3,959,860 (Schindler), 3,941,555 (Anderson et al) and 3,897,196 (Sanders et al). These leads provide the needed current path to the lamp's primer material which, when activated, ignites a quantity of combustible material (e.g. shredded zirconium) to produce the desired highly intense flash of light.

Understandably, the requirement for using two leads substantially limits attempts to minimize the spacing requirements in designing the above lamps. The requirement for a second lead member also increases the opportunity for an improper seal between this member, which is normally metallic, and the envelope, which is typically of glass material.

At least one early attempt was made to produce a single lead, electrically fired flash lamp. As shown in U.S. Pat. No. 2,768,517 (R. H. Atkinson et al), a single aluminum lead was located within a plastic base and projected within a glass envelope. Successful activation was only possible when an extremely high potential (e.g. 10,000 to 20,000 volts) was applied across the lead and a spaced reflector was capacitively joined to the lamp's internal combustible material (e.g. aluminum foil). It was further necessary in U.S. Pat. No. 2,768,517 to provide a dielectric layer on the external surface of the portion of the lead which extended within the envelope. Crevices were required in this layer to provide a path for the spark discharge which then passes through spaced apertures in a porous primer. As a result of the above requirements, particularly the need for an activating potential in excess of 10,000 volts, most modern day engineering efforts have been directed toward the aforementioned dual lead embodiments. The disadvantages associated therewith are apparently more tolerable by engineering standards in comparison to the problems inherent in supplying excessively high quantities of electrical energy.

It is believed, therefore, that a single lead, electrically-activated flash lamp which can be successfully fired at potentials substantially less than those required in the aforedescribed prior art would constitute a significant advancement in the art.

OBJECTS AND SUMMARY OF THE INVENTION

It is therefore a primary object of the present invention to provide an electrically-activated flash lamp wherein only one conductive lead is employed.

It is a further object of the invention to provide a flash lamp of the variety described wherein successful activation of the lamp is accomplished at relatively lower electrical potentials than earlier single lead efforts.

As will be understood from the following description, another object of the invention is the provision of a sequential flashing array of the above lamps.

In accordance with one aspect of the invention, a flash lamp is described which comprises a light-transmitting envelope, a quantity of filamentary combustible material within the envelope, a conductive lead which protrudes within the envelope, a quantity of primer material which covers the protruding end of the lead, and an electrically conductive coating located on an external surface of the envelope in capacitively coupled relationship to the combustible material.

In accordance with another aspect of the invention, a flash lamp is described which includes many of the features of the above lamp in addition to a second coating located on the internal surface of the envelope. Both coatings are capacitively coupled with the internal coating being directly connected to the combustible material.

According to still another embodiment of the invention, a sequentially-activated flash lamp array is provided which includes a plurality of the aforementioned flash lamps, a circuit which interconnects the lamps in a desired arrangement with a pair of activating pulse input terminals, and a quantity of switch material across the conductive lead of the lamp and a second, partially penetrating lead adjacent thereto. The heat of the lamp causes the switch material to change from a high resistance state to one of relatively low resistance.

DETAILED DESCRIPTION OF THE PREFERRED EMBODIMENTS

For a better understanding of the present invention together with other and further objects, advantages and capabilities thereof, reference is made to the following disclosure and appended claims in connection with the above-described drawings.

Figure 1:
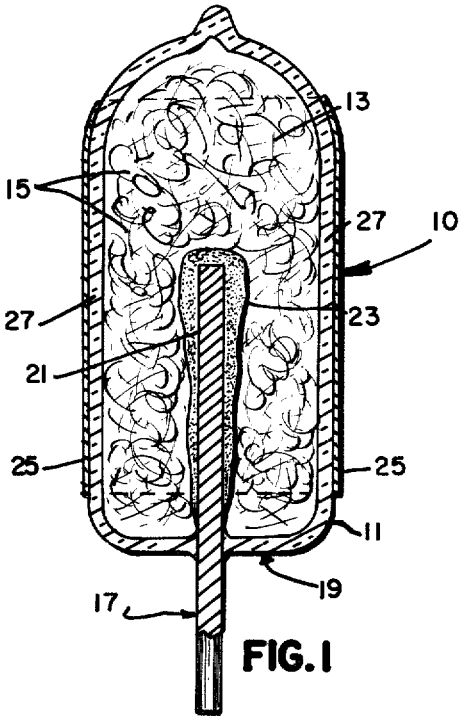
FIGS. 1 and 2 are elevational views, in section, of single lead flash lamps in accordance with preferred embodiments of the invention.

With particular reference to FIG. 1, there is shown an electrically-activated flash lamp 10 which comprises a hermetically-sealed, light-transmitting envelope 11 which defines a chamber 13 therein. A combustion-supporting atmosphere, e.g. oxygen, is established within chamber 13 at a pressure which is preferably several, e.g. 5-10, atmospheres. Also within chamber 13 is a quantity of filamentary combustible material 15, e.g. shredded zirconium or hafnium. Lamp 10 further comprises a single electrically conductive lead member 17 which is secured to and extends from an end 19 of envelope 11. Lead 17 has an end portion 21 which protrudes within chamber 13 and is covered with a quantity of primer material 23. Lead 17 is preferably a metallic alloy and has a coefficient of expansion compatible to that of the glass used for envelope 11. If a soft (e.g. lead) glass is used, lead 17 is preferably Sylvania No. 4 alloy. Primer 23 comprises a mixture of combustible metal powder, e.g. zirconium, one or more metal oxides, e.g. cobalt or tungsten, and a binding agent such as nitrocellulose. Primer 23 covers the entire end 21 of lead 17 to prevent electrical shorting between filaments 15 when the activating pulse is applied to lamp 10.

Located on the external surface of envelope 11 is a thin, transparent coating of electrically conductive material such as tin oxide or indium oxide doped with tin. As indicated, coating 25 covers a major portion of envelope 11, excluding the envelope's upper tip portion and lower end 19. It is understood that coating 25 does not contact that portion of lead 17 which projects from end 19. Coating 25 preferably has a surface resistivity within the range of from about 100 to 50,000 ohms per square.

In operation, lamp 10 is activated by the application of a voltage pulse of from 1000 to 3000 volts across lead 17 and coating 25. When the lamp is employed in combination with a camera, the camera's power source applies the above pulse. The preferred source used in many of today's cameras is the piezoelectric crystal which, when mechanically impacted, produces a high voltage, low energy pulse. In one example, lamp 10 was successfully flashed in circuitry employing a crystal which produced about 3000 volts upon impact thereof. Application of this potential produces a capacitive discharge from coating 25 through dielectric wall 27 to material 15. The circuit through lamp 10 is completed by the direct connection between material 15 and the conductive primer 23, which is in direct contact with lead 17. The result is an ignition of primer 23 which thereafter ignites the readily combustible filaments 15 to produce the desired intense flash of light.

Figure 2:
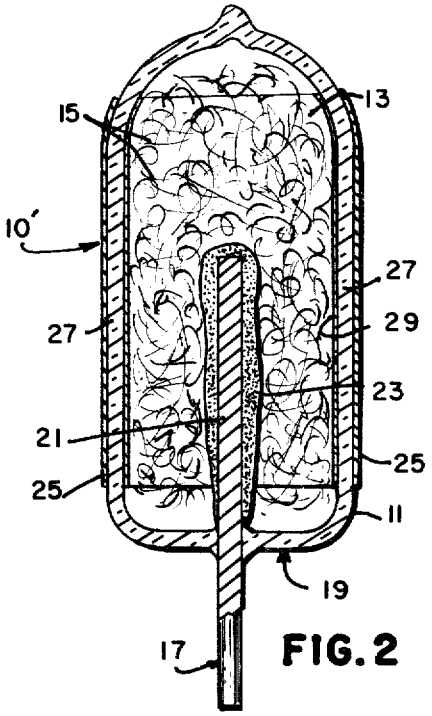

Lamp 10' in FIG. 2 includes components similar to those of lamp 10 with the addition of a second coating 29 located on the internal surface of envelope 11. Coating 29 is preferably of similar material to that of coating 25 and is located within the envelope opposite the external conductor. This internal coating is also transparent and preferably possesses the same surface resistivity as its external counterpart. Accordingly, coatings 25 and 29 are capacitively coupled upon application of a suitable pulse (e.g. from the aforementioned piezoelectric crystal) to lead 17 and coating 25. In lamp 10', the combustible material 15 is in direct contact with coating 29. The remainder of the lamp's circuit is completed similarly to that of lamp 10.

Lamps of the invention were produced which had an envelope about 0.80 inches long, an internal volume from about 0.05 to 0.06 cubic inches, a diameter of 0.30 inches and a wall thickness ranging from about 0.01 to 0.04 inches. The above dimensions are not meant to limit the invention. For example, lamps having a much broader range of internal volumes (e.g. from 0.01 to 0.06) could be produced and successfully fired.

Figure 3:
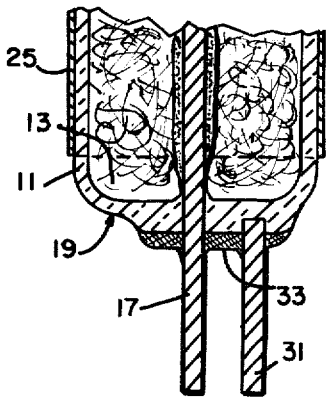
FIG. 3 is an elevational view, in section, of an end portion of a flash lamp of the invention, illustrating the positioning of a second lead therein.

In FIG. 3 there is shown an alternate embodiment of an end portion 19 for either of the lamps of FIGS. 1 and 2. End 19 includes a second conductive lead 31, similar in material to that of lead 17, which is secured to end 19 at a spaced location from lead 17. Lead 31 only penetrates a portion of end portion 19. It is important to note that lead 31 does not extend within chamber 13 to thereby increase the chances for an inadequate seal at this end of the lamp. Such a possibility is eliminated by the relatively minor, insignificant penetration by lead 31.

Also shown in FIG. 3 is a quantity of thermally responsive switch material 33 which is coated on end 19 of the lamp and bridges leads 17 and 31. In operation, material 33 possesses a high resistance prior to flashing of the respective lamp adjacent thereto such that electrical current passing through lead 17 will not enter lead 31 prior to flashing of the lamp. Understandably, external coating 25 is spaced a sufficient distance from material 33 and leads 17 and 31 to also assure prevention of the above shorting. The heat generated by the lamp's flashing affects the resistivity of material 33 such that the material will now readily pass current therethrough. An example of a material suitable for use for material 33 is silver carbonate and is described in U.S. Pat. No. 4,040,777 (E. J. Collins et al). The above composition is applied to end 19 in pasta like form and permitted to dry. An external coating may be thereafter applied over material 33 to protect it from potentially adverse environmental conditions such as high humidity.

Figure 4:
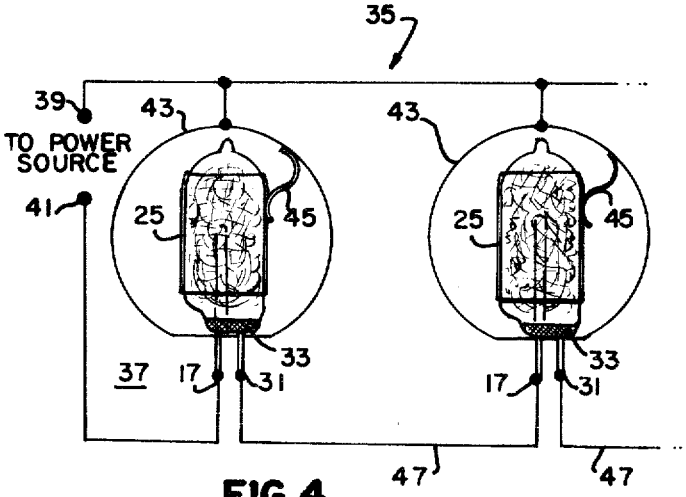
FIG. 4 is a schematic diagram of an electrical circuit which utilizes the flash lamps of FIGS. 1 and 2.

In FIG. 4 there is illustrated a sequentially-activated array 35 of flash lamps similar to those shown in FIG. 1 and 2. That is, array 35 may comprise a plurality of the single coating lamps 10 of FIG. 1, or the dual coating lamps 10' of FIG. 2, or combinations of both. Array 35 comprises a plurality (e.g. four) of the aforedescribed lamps, circuit means 37, and the defined switch material 33 which provides the necessary interconnection between the two leads 17 and 31 (as shown in FIG. 3). For reasons of simplicity, only two lamps are shown in array 35.

Circuit means 37 includes first and second activating pulse input terminals 39 and 41 across which can be applied the necessary activating pulse from the piezoelectric crystal. First terminal 39 is electrically connected in common to the external conductive coatings 25 in each lamp while second terminal 41 is directly joined to the first lead 17 of the first lamp in the array to be activated (to the left in FIG. 4). Array 35 may include a reflector 43 for each lamp to enhance its forward output. In this event, reflectors 43 will each be electrically conductive and located immediately adjacent a respective lamp. Each is also directly joined to the respective coating 25 via a suitable connection such as provided by resilient contact 45. A suitable conductive material for contact 45 is aluminum. Should it be desirable not to use reflectors 43 in array 35, first terminal 39 will be directly joined in common to coatings 25. It may be desirable to provide a protective, insulative coating on the exterior of the lamps of the invention, such a coating also covering the external conductive coating 25. One well known material suitable for this purpose is cellulose acetate. In the event that such a protective coating is employed, portions thereof would be removed to permit electrical connection between the conductive coating 25 and the designated external contact 45.

In operation, the required activating pulse is applied across terminals 39 and 41 to flash the first lamp in the array. The conductivity of switch material 33 located on this lamp is now increased such that the second lamp (to the right in FIG. 4) is now electrically connected to terminal 41. Circuit 37 further includes meand 47, e.g. an electrical wire, for connecting second lead 31 of the first lamp to lead 17 of the second lamp. The circuit includes several such connections depending on the number of lamps in the circuit. Accordingly, the total number of connections 47 in circuit 37 will equal the number of lamps minus one. The last lamp will of course not require such a connector nor, for that matter, a second lead 31 and switch material 33. Upon flashing, the shredded filamentary material is consumed within the envelope so that no connection will now exist between the protruding end of the lamp and the inside wall (or internal coating). In effect, the lamp has become an open circuit and will thus not load subsequent triggering pulses needed to subsequently activate remaining lamps in the array.

There has thus been shown and described a single lead, electrically-activated flash lamp which is capable of being successfully activated at electrical potentials substantially less than known single lead lamps. As such, the invention is readily adaptable to many modern day camera applications wherein the power source typically associated with such cameras is a piezoelectric crystal. By use of but a single lead, the invention significantly reduces the possibilities for an inadequate seal between the lamp's glass envelope and the metallic leads normally used therein.

The lamp as has been defined is inexpensive to produce and is particularly adapted for use in combination arrays with other, similar lamps. The invention may be manufactured using techniques well known in the art for making dual lead lamps and further description is not believed necessary. If desirable to include the second conductive lead (described in FIG. 3), the bottom, sealed end 19 of the lamp may be heated to a temperature sufficient to permit positioning of this lead therein. Thereafter, the end is allowed to cool and the switch material 33 applied in paste like form. For lamps having an internal coating 29, this coating is applied using known techniques (e.g. those known in fluorescent lamp manufacturing) prior to sealing the upper tip portion of envelope 11. The external coating 25 can be applied by inverting the sealed lamp and dipping envelope 11 within the coating material to the specified depth. Another acceptable method for applying this coating is chemical vapor deposition.

While there have been shown and described what are at present considered the preferred embodiments of the invention, it will be obvious to those skilled in the art that various changes and modifications may be made therein without departing from the scope of the invention as defined by the appended claims.

What is claimed is:

1. An electrically-activated flash lamp comprising:

a hermetically-sealed, light-transmitting envelope defining a chamber therein;

a combustion-supporting atmosphere within said chamber;

a quantity of filamentary combustible material within said chamber;

a single electrically conductive lead member secured to and extending from one end of said envelope, said conductive lead member having an end portion protruding within said chamber;

a quantity of primer material covering said protruding end portion of said lead member; and an electrically conductive coating positioned on the external surface of said envelope in capacitively coupled relationship to said filamentary combustible material within said chamber, said capacitive coupling occurring through the wall of said envelope.

2. The flash lamp according to claim 1 wherein said electrically conductive coating is light-transmitting.

3. The flash lamp according to claim 2 wherein the material of said coating is selected from the group consisting of tin oxide and indium oxide doped with tin.

4. The flash lamp according to claim 3 wherein said coating has a surface resistance with the range of about 100 to about 50,000 ohms per square.

5. The flash lamp according to claim 4 wherein said envelope is glass, said wall of said envelope having a thickness within the range of about 0.01 to about 0.04 inches.

6. The flash lamp according to claim 1 further including a second electrically conductive lead member secured to said end of said envelope at a spaced location from the other conductive lead member and not protruding within said chamber of said envelope, said flash lamp further including a quantity of switch material located externally of said envelope and bridging said conductive lead members, said switch material having a high resistance prior to activation of said flash lamp and responsive to the heat produced by said flash lamp when said lamp is activated, said material thereafter having a substantially lower resistance.

7. The flash lamp according to claim 6 wherein said switch material is comprised of silver carbonate.

8. An electrically-activated flash lamp comprising:

a hermetically-sealed, light-transmitting envelope defining a chamber therein;

a combustion-supporting atmosphere within said chamber;

a quantity of filamentary combustible material within said chamber;

an electrically conductive lead member secured to and extending from one end of said envelope, said conductive lead member having an end portion protruding within said chamber;

a quantity of primer material covering said protruding end portion of said lead member;

a first electrically conductive coating positioned on the internal surface of said envelope in electrical contact with said filamentary combustible material; and a second electrically conductive coating positioned on the external surface of said envelope in capacitively coupled relationship to said first conductive coating, said capacitive coupling occurring through the wall of said envelope.

9. The flash lamp according to claim 8 wherein each of said first and second electrically conductive coatings is light-transmitting.

10. The flash lamp according to claim 9 wherein the material of each of said coatings is selected from the group consisting of tin oxide and indium oxide doped with tin.

11. The flash lamp according to claim 10 wherein each of said coatings has a surface resistance within the range of about 100 to 50,000 ohms per square.

12. The flash lamp according to claim 11 wherein said envelope is glass, said wall of said envelope having a thickness within the range of about 0.01 to about 0.04 inches.

13. The flash lamp according to claim 8 further including a second electrically conductive lead member secured to said end of said envelope at a spaced location from the other conductive lead member and not protruding within said chamber of said envelope, said flash lamp further including a quantity of switch material located externally of said envelope and briding said conductive lead members, said switch material having a high resistance prior to activation of said flash lamp and responsive to the heat produced by said flash lamp when said lamp is activated, said switch material thereafter having a substantially lower resistance.

14. The flash lamp according to claim 13 wherein said switch material is comprised of silver carbonate.

15. A sequentially-activated flash lamp array comprising:

a plurality of electrically-activated flash lamps each including a hermetically-sealed, light-transmitting envelope defining a chamber therein, a quantity of filamentary combustible material within said chamber, a first electrically conductive lead member secured to and extending from one end of said envelope and having an end portion which protrudes within said chamber, a second electrically conductive lead member secured to said end of said envelope at a spaced location from said first electrically conductive lead member and not protruding within said chamber, a quantity of primer material covering said protruding end of said first lead member, and an electrically conductive coating positioned on the external surface of said envelope in capacitively coupled relationship to said filamentary combustible material, said capacitive coupling occurring through the wall of said envelope;

circuit means including first and second activating pulse input terminals, said first input terminal electrically connected in common to said conductive coating positioned on said external surface of each of said envelopes said second input terminal electrically connected to the first conductive lead member of a first of said flash lamps to be activated, said circuit means further including means for electrically joining the second conductive lead member of each of said flash lamps, including said first flash lamp but excluding not necessarily the last flash lamp to be activated, to the first conductive lead member of the next succeeding flash lamp in said array to be activated; and a quantity of switch material bridging said first and second conductive lead members of each of said flash lamps, excepting not necessarily said last flash lamp, at a position externally of and adjacent said envelope of said flash lamp, said switch material having a high resistance prior to activation of said adjacent flash lamp and responsive to the heat produced by said flash lamp when said lamp is activated, said switch material thereafter having a substantially lower resistance.

16. The flash lamp array according to claim 15 further including a plurality of electrical conducting reflectors, each of said reflectors located adjacent a respective one of said flash lamps and electrically joined to said external conductive coating positioned on said envelope.

17. A sequentially-activated flash lamp array comprising:

a plurality of electrically-activated flash lamps each including a hermetically-sealed, light-transmitting envelope defining a chamber therein, a combustion-supporting atmosphere within said chamber, a quantity of filamentary combustible material within said chamber, a first electrically conductive lead member secured to and extending from one end of said envelope and having an end portion which protrudes within said chamber, a second electrically conductive lead member secured to said end of said envelope at a spaced location from said first conductive lead member and not protruding within said chamber, a quantity of primer material covering said protruding end portion of said first lead member, a first electrically conductive coating positioned on the internal surface of said envelope in electrical contact with said filamentary combustible material, and a second electrically conductive coating positioned on the external surface of said envelope in capacitively coupled relationship to said first conductive coating, said capacitive coupling occurring through the wall of said envelope;

circuit means including first and second activating pulse input terminals, said first input terminal electrically connected in common to said second conductive coating positioned on said external surface of each of said envelopes, said second input terminal electrically connected to the first conductive lead member of a first of said flash lamps to be activated, said circuit means further including means for electrically joining the second conductive lead member of each of said flash lamps, including said first flash lamp but excluding not necessarily the last flash lamp to be activated, to the first conductive lead member of the next succeeding flash lamp in said array to be activated; and a quantity of switch material bridging said first and second conductive lead members of each of said flash lamps, excepting not necessarily said last flash lamp, at a position externally of and adjacent said envelope of said flash lamp, said switch material having a high resistance prior to activation of said adjacent flash lamp and responsive to the heat produced by said flash lamp when said lamp is activated, said switch material thereafter having a substantially lower resistance.

18. The flash lamp array according to claim 17 further including a plurality of electrically conducting reflectors, each of said reflectors located adjacent a respective one of said flash lamps and electrically joined to said external conductive coating positioned on said envelope.

* * * * *